United States Patent [19]

Howard

[11] 4,142,340

[45] Mar. 6, 1979

[54] BUILDING ENCLOSURE MADE FROM STANDARD CONSTRUCTION UNIT IN SIDE WALLS AND ROOF DECK

[76] Inventor: Milton L. Howard, 21 Banbury La., Bloomfield, Conn. 06002

[21] Appl. No.: 814,449

[22] Filed: Jul. 11, 1977

[51] Int. Cl.[2] ..... E04B 1/00

[52] U.S. Cl. ..... 52/262; 52/293; 52/582; 52/602; 52/612; 52/574

[58] Field of Search ..... 52/264, 293, 582, 583, 52/602, 630, 405, 574, 612, 262, 729

[56] References Cited

U.S. PATENT DOCUMENTS

| | | | |
|---|---|---|---|
| 1,990,155 | 2/1935 | Young | 52/729 |
| 2,129,369 | 9/1938 | Faber | 52/574 X |
| 2,202,745 | 5/1940 | Mose | 52/293 X |
| 3,328,931 | 7/1967 | Smith | 52/729 |
| 3,462,898 | 8/1969 | Balency-Bearn | 52/612 X |
| 3,979,863 | 9/1976 | Hurley et al. | 52/583 X |
| 4,030,262 | 6/1977 | Dean | 52/583 |

*Primary Examiner*—Price C. Faw, Jr.
*Assistant Examiner*—Carl D. Friedman

[57] ABSTRACT

A standard construction unit is provided by a monolithic precast reinforced concrete panel which has a generally rectangular peripheral configuration. A pair of flanges project from and extend longitudinally along the opposite sides of one face thereof to provide the unit with a shallow U-shaped cross-section. Connector elements are embedded within the other face of the panel adjacent its sides to permit connection of it to adjacent like panels. Door or window openings may be provided in the web portion.

A building structure is supported on a footing and has walls, a roof and, optionally, a floor formed from the standard panels. The walls are formed by a plurality of the panels disposed vertically in side-by-side relationship and connected to each other by side fastener means bridging the panels and engaged with the connector elements and, at their lowermost ends, to the footing. Roofs and floors are formed by a plurality of similar panels similarly connected to each other and disposed horizontally with their flanges projecting downwardly and resting on the wall panels. The roof panels are connected to the upper ends of the walls. The standard construction unit may have a heat insulating layer overlying the major portion of the other surface and provides a simple, relatively inexpensive and aesthetically pleasing building enclosure.

9 Claims, 17 Drawing Figures

BUILDING ENCLOSURE MADE FROM STANDARD CONSTRUCTION UNIT IN SIDE WALLS AND ROOF DECK

BACKGROUND OF THE INVENTION

The present invention concerns a standard construction unit and building enclosures made therefrom. More particularly, the present invention concerns precast units which may be made in a standardized configuration and assembled at the construction site to form a wide variety of buildings such as single or multiple-story buildings.

Over the years, numerous schemes have been advanced for providing more or less standardized prefabricated units capable of being assembled into a building or other structure. For example, an early patent, U.S. Pat. No. 375,999, shows an arched stone or concrete pavement block utilizing metal tie rods and adapted to be received within a supporting foundation to support a pavement surface. U.S. Pat. No. 457,984 shows a ribbed wall plaster construction having a ribbed side and a flat side from which flat surfaced walls may be assembled. U.S. Pat. No. 1,477,665 shows a concrete building assembled from individual concrete slabs which are pinned together by reinforcing rods which extend through all the slab sections of a wall. U.S. Pat. No. 1,393,996 shows a concrete building structure in which walls, floor and ceiling may be assembled from precast concrete slabs which are tied together by tie rods and a groove construction.

U.S. Pat. No. 2,171,338 shows a building member comprising U-shaped cross-section channel members having slotted flanges and adapted to enclose structural steel members. U.S. Pat. No. 3,101,572 shows U-shaped structural members of glass to form walls, floors, etc. Other U.S. patents employing precast slab construction and typical of numerous other patents in the field are U.S. Pat. Nos. 1,421,007; 1,666,199; 2,160,773 (which shows building blocks flat on one side and concave on the other with connecting wire loops embedded in the blocks) and 2,116,946.

There are numerous problems associated with attempts to use precast building elements to fabricate structures and some of these are illustrated by some of the above-mentioned U.S. patents. One common problem is the requirement to provide a supporting steel structure for the precast elements. Another is the requirement to provide numerous different configurations and sizes of the precast panels or units for floors, walls and roofs in order to provide a complete structure made therefrom. This disadvantage often requires a precast panel to be custom designed for each job and loses much of the advantage otherwise to be gained from prefabrication of parts.

Another difficulty with many of the prior art attempts is that more or less complex panel designs must be provided, as well as numerous tie rods, connecting fixtures and the like, all of which increases the complexity and number of parts required and correspondingly complicate the construction and assembly techniques required. This requires skilled or highly experienced labor and supervision to erect the structure. The latter factor is particularly significant in areas where it is desired to provide employment for relatively unskilled workers or where sufficient numbers of skilled and experienced workers are unavailable or their labor costs exceedingly high.

Not the least of the problems associated with buildings assembled from precast modular units of the prior art is their lack of aesthetic appeal. Precast concrete buildings are generally afflicted by aesthetically unpleasing appearance with virtually no possibility of providing a varied or pleasing design from standardized precast parts.

Yet another difficulty with structures assembled from prior precast standardized units is a limited structural strength which normally requires the provision of an additional steel framework, particularly if a multiple stored building is to be provided.

The object of the present invention is to provide a novel modular construction element and structures made therefrom which overcomes problems such as the foregoing and which provides a standardized readily prefabricated modular unit which may be assembled to form a wide variety of aesthetically attractive structures by relatively unskilled labor and without the necessity of employing complicated fastening means, accessories or construction techniques.

It is another object of the present invention to provide a novel modular standard construction unit which is easily and relatively inexpensively fabricated, which is of standard configuration and which may be employed in modified forms to provide the walls, floors and ceilings of a building structure.

It is another object of the present invention to provide such a novel modular construction unit made of reinforced cast concrete.

It is another object of the present invention to provide a novel building structure made from modular standard construction units as above which structures may be varied in form, have a pleasing aesthetic appearance and which may be readily assembled by relatively unskilled labor. Other objects and advantages of the present invention will be apparent from the following description.

SUMMARY OF THE INVENTION

It has now been found that the foregoing and related objects may be readily attained in a building enclosure which has a multiplicity of side walls and a roof deck extending therebetween. The enclosure utilizes a multiplicity of standard construction units comprising a precast concrete monolithic panel of substantially rectangular configuration and having a generally U-shaped transverse cross section defined by one face having a pair of flanges longitudinally extending along the sides thereof with the surface of that face being substantially planar therebetween and by the other face which is substantially planar. Each of the construction units has at least a plurality of longitudinally spaced-apart side connector elements in the other face on each side thereof. The enclosure includes a footing which provides a support surface and a multiplicity of the standard construction units are vertically disposed upon the footing to provide each of the side walls. The construction units have their side edges abutting and at least one of the side connector elements of each is horizontally aligned with a side connector element of the adjacent unit. In addition, a multiplicity of the standard units are horizontally disposed upon the upper ends of the side walls and extend therebetween to provide the roof deck, and the sides of the roof deck standard units are in abutting relationship. Side fastener means bridge the adjacent sides of the adjacent construction units in both the side walls and the roof deck, and the fastener means are engaged with the connector elements of the adjacent construction units.

In the preferred assembly, the side connector elements are embedded within the construction units and the side fastener means include plate members extending across the sides of the construction units and overlying the side connector elements. Fasteners cooperate with the side connector elements to lock the plate members to the side connector elements and thereby the construction units in the side-by-side relationship.

Most desirably the plate members have slots therein and the fasteners are seated in the slots, and these slots conveniently have their longitudinal axes disposed perpendicularly to each other.

In one form of the assembly, the standard construction units additionally have in the flanges of adjacent units a plurality of aligned, transversely extending apertures, and fastener elements are seated in the apertures of the adjacent construction units to secure them in assembly.

The support surface of the footing and the lower ends of the standard construction units of the side walls most usually have aligned apertures therein and end connectors are seated in these aligned apertures. The upper ends of the standard units of the side walls and the overlying portions of the standard units of the roof deck may also have aligned apertures therein and end connectors are seated in these aligned apertures.

The corners of the building enclosure may be defined by a pair of construction units extending perpendicularly to each other with the side wall of one unit abutting the other surface of the cooperating construction unit. In such an assembly, the side fastener means includes plate members of generally L-shaped configuration overlying the side connector elements and fasteners cooperating with the side connector elements to lock the plate members to the side connector elements.

DETAILED DESCRIPTION OF THE ILLUSTRATED EMBODIMENTS

Figure 1:
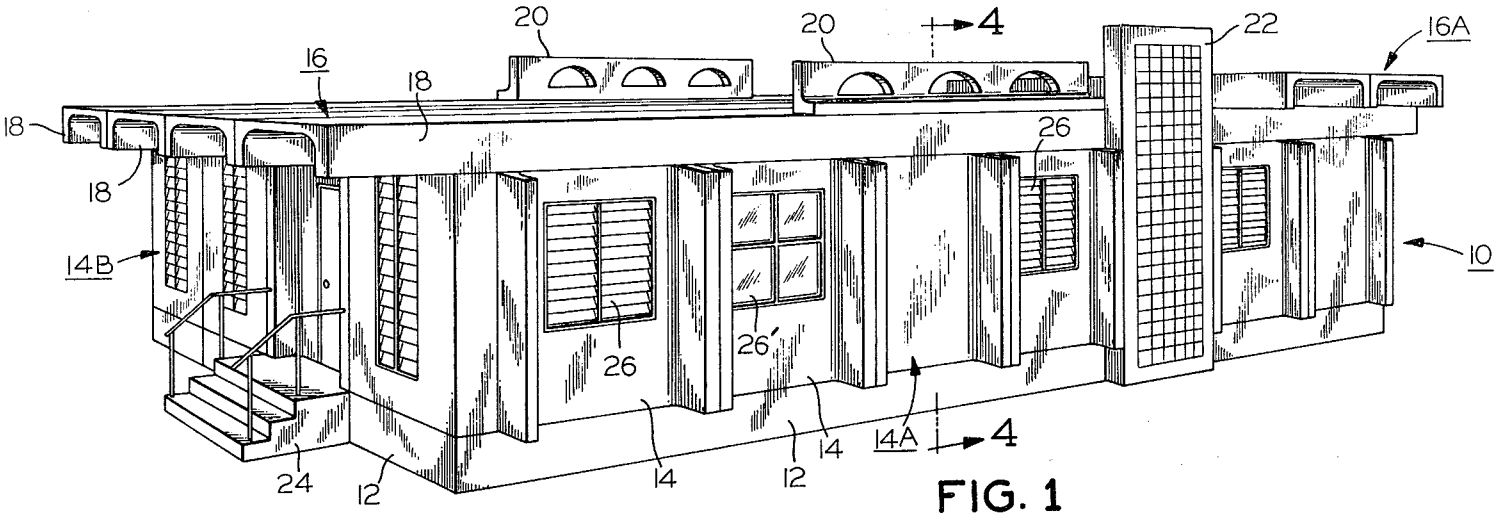
FIG. 1 is a perspective view of one embodiment of a building enclosure fabricated by standard construction panels of the present invention.

Referring now to FIG. 1, there is shown a perspective view of a building enclosure generally indicated at 10 and including a footing 12 on which a plurality of vertically positioned standard construction units modified to serve as wall panels 14 are supported to provide a wall 14A. Wall panels 14 are provided by panels such as those illustrated at 14, 14″ in FIG. 3A and FIG. 3B and by panels 14, 14′ of FIG. 2. A second wall 14B is disposed perpendicularly to wall 14A and is similarly formed of wall panels 14, which are reverse positioned, except for the panel containing the door, as will be more fully described hereinbelow. The wall panel containing the door is provided by a panel such as that illustrated in FIG. 3A. A roof deck 16 is formed of a plurality of standard construction units positioned horizontally with their flanges downward and modified to serve as roof panels 18. An intermediate portion of roof deck 16 is provided with parapets 20. The right hand section of roof deck 16 (as viewed in FIG. 1) is provided with a thermally insulating second roof deck 16A. Thus, for illustrative purposes, building 10 is provided with three different roof treatments, comprising a plain roof as shown in the left-hand portion of the building of FIG. 1, a parapet enclosed roof illustrated in the center portion, and a double decked roof illustrated at the right-hand portion. Obviously, the entire roof deck would usually, although not necessarily always, have the same construction. A decorative vertical slab 22 is positioned between the flanges of one of the wall panels 14 for aesthetic architectural purposes. Porch steps 24 lead to a door provided in the "normal" (flanges out) positioned one of the wall panels forming wall 14B. It will be noted that the "reverse positioned" (flanges in) positioned wall panels of wall 14B have tall window openings, provided by panels such as those illustrated in FIG. 3A which have been positioned upside down, relative to the position shown in FIG. 3A. Louvred windows 26 and a casement window 26′ are illustrated in wall 14A. Wall panels such as that illustrated in FIG. 3B are used to provide window openings.

Figure 2:
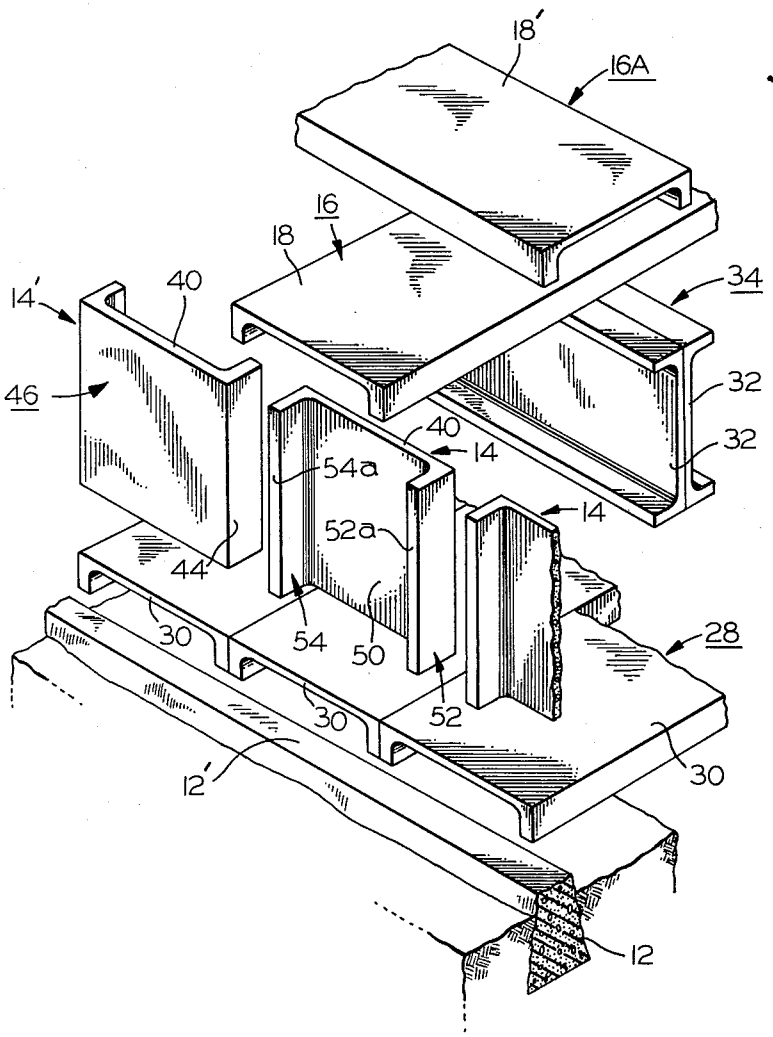
FIG. 2 is a perspective, diagrammatic, partially exploded view showing the relationship of standard construction units in a number of variations employed in a building enclosure.

FIG. 2 shows schematically in exploded view the relative positioning of the various standard construction units or panels. Footing 12 may be any conventional type of footing or foundation wall having a support surface 12'. In FIG. 2, a floor deck 28 is formed of a plurality of standard construction units modified in a manner similar to the roof panel 18, but in this case comprising floor panels 30. Wall panels 14 and 14' are vertically disposed to provide a wall, with wall panel 14' being a reverse positioned wall panel; i.e., one whose flanges project inwardly of the building enclosure. Obviously, the terms "normal" and "reverse" positioned are descriptions which pertains to exterior building walls. When wall panels 14 are employed as interior or partition walls the terms lose their meaning.

A single roof panel 18 is shown in FIG. 2 to illustrate a component of roof deck 16, and a single roof panel 18' is shown disposed transversely of roof panel 18 to illustrate a panel component of second, thermal roof deck 16A. Also illustrated in FIG. 2 is a pair of standard construction units modified to comprise girder panels 32, which are joined together in face to face abutting relationship to comprise an I-beam shaped, horizontally disposed girder member 34. It will be appreciated that girder member 34 may be positioned vertically to comprise a column member. While girder members, column members and floor decks such as illustrated in FIG. 2 may be employed in building enclosures in accordance with the invention, generally a building enclosure such as building enclosure 10 illustrated in FIG. 1 will require only the footing, walls and roof deck, the girders, columns and floor decks being optional. For example, if soil conditions are suitable, floor deck 30 illustrated in FIG. 2 may be dispensed with and the floor may be provided by a concrete pad poured directly on top of the soil within the enclosure provided by footing 12. For multistory building enclosures in accordance with the invention, the roof deck of one story of course serves as the floor deck of the story above. Obviously, wall panels may be, and usually are, of different length and/or proportions from roof panels; panels for floor decks and girders and columns, when used, may be appropriately sized.

Figure 3C:
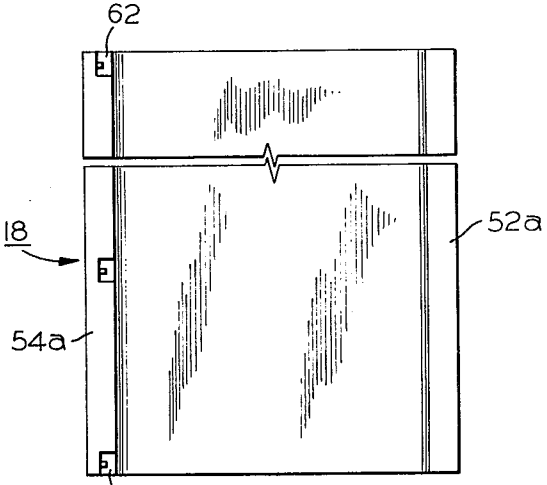
FIG. 3C is a bottom plan view of a standard construction unit embodiment adapted for use as a roof panel.
Figure 3B:
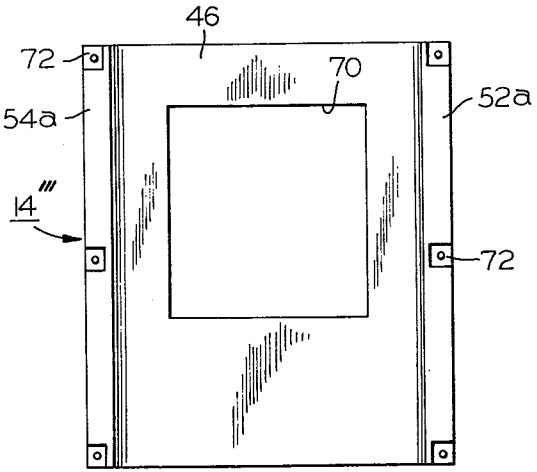
FIG. 3B is a front elevational view of yet another embodiment of a standard construction unit.
Figure 3A:
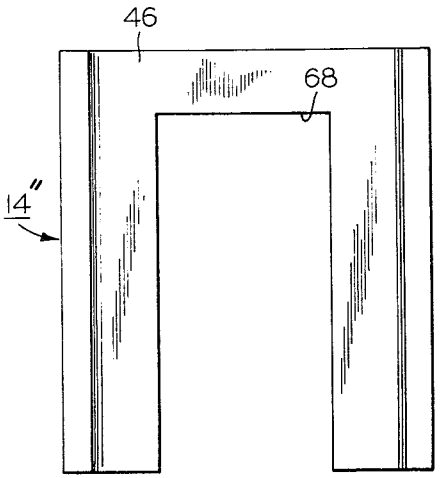
FIG. 3A is a front elevational view of another embodiment of a standard construction unit.
Figure 3:
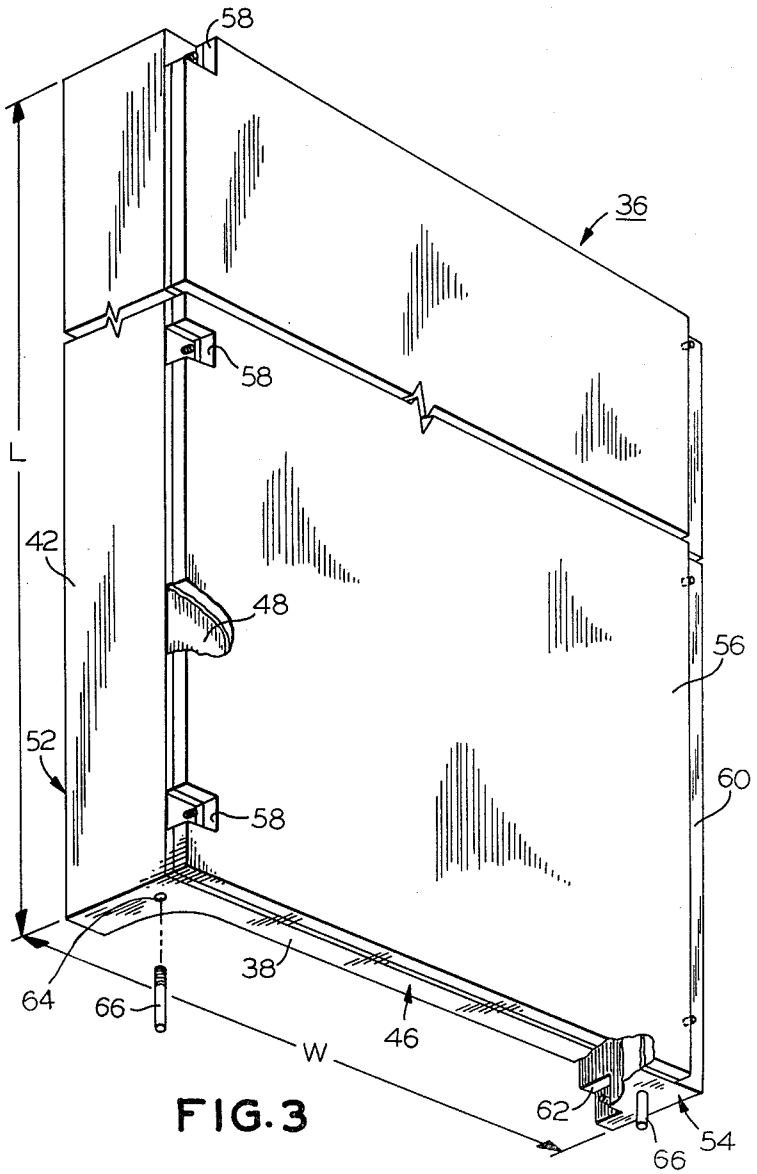
FIG. 3 is a perspective view with parts broken away of one embodiment of a construction unit fabricated in accordance with the present invention.

FIG. 3 illustrates a standard construction unit in accordance with the present invention. For illustrative purposes only, the construction unit of FIG. 3 is shown with several different types of connectors, not all of which are normally required in a single construction unit panel.

FIG. 3 shows a standard construction unit generally indicated at 36 and comprising a precast monolithic unit of generally rectangular configuration whose periphery is defined by a first end wall 38 and a second, opposite end wall 40, not visible in FIG. 3. For fuller illustration, panel 14' and full panel 14 of FIG. 2 have portions thereof numbered to correspond to those identical portions of standard construction unit 36 which are not visible in FIG. 3. Thus, second end walls 40 of panels 14, 14' are shown in FIG. 2 and correspond to second end wall 40 of unit 36 of FIG. 3. The remainder of the periphery of unit 36 is defined by a pair of opposite lateral side walls 42 and 44, the latter not visible in FIG. 3 and illustrated by lateral side wall 44 of panel 14' of FIG. 2. The unit 36 (see also panel 14' of FIG. 2) has a first surface 48 and an opposite second surface or face 50, not visible in FIG. 3 but shown in full panel 14 of FIG. 2. A pair of spaced apart parallel flanges 52, 54 (FIGS. 2 and 3) project from opposite sides of second surface 50 and extend substantially coextensively with the length of unit 36 to provide construction unit 36 with a shallow substantially U-shaped transverse cross section defined by the flanges 52, 54 and web portion 46. Side walls 42, 44 are parallel to each other and first end wall 38 is parallel to second end wall 40. End walls 38, 40 are disposed perpendicularly relative to side walls 42, 44. In the preferred embodiment illustrated, first surface 48 and second surface 50 between the flanges 52, 54 are substantially flat or planar, and flanges 52, 54 terminate in flat flange edges 52*a*, 54*a* (FIG. 2). The inner sides of flanges 52, 54 are concavely curved, as seen in the lowermost portion of FIG. 3.

Standard construction unit 36 has a facing layer 56 (partly broken away to show first surface 48) of heat insulating material affixed to and overlying it. Heat insulating layer 56 extends over significantly all of first surface 48 of unit 36. By "significantly all" is meant that only minor portions are cut away to allow for recesses for connector means and abutment of adjacent corner panels as described below. These recesses are normally filled after assembly. Thus, a plurality of spaced apart recesses 58 are formed adjacent side wall 42 in facing layer 56 to accommodate the projecting ends of side connector elements, unnumbered in FIG. 3. At the right-hand edge of FIG. 3, overlying layer 56 is seen to terminate short of sidewall 44 (unnumbered in FIG. 3) to define a shoulder recess 60 in facing layer 56, within which a second plurality of unnumbered side connectors are disposed. It will be noted that in the illustrated embodiment, facing layer 56 is comprised of two separate layers, as will be more fully described hereinbelow.

In the lower right-hand portion of FIG. 3, a portion of unit 36 is broken away to show a flange connector recess 62 formed in the inner side of flange 62 to receive a flange connector means therein as more fully described hereinbelow.

First end wall 38 has a pair of spaced apart apertures, one of which is numbered 64 in FIG. 3, within each of which is received an end connector 66. End connectors 66, when affixed to unit 36, project exteriorly of first end wall 38 as shown in the lower right hand portion of FIG. 3.

Standard construction unit 36 is preferably made of a monolithic precast concrete panel which is reinforced by having conventional reinforcing members embedded therein. Preferably, the reinforcing members comprise conventional steel reinforcing rods and steel mesh embedded within standard construction unit 36, and construction unit 36 is so dimensioned that it acts as a channel member under loading stresses.

The standard portion of the standard construction unit comprises the precast panel having a web portion and a pair of parallel extending side flanges together with a plurality of side connector elements 74 seated in recesses and exposed in first surface 48 thereof, all as seen in FIG. 3. Structural unit 36 modified to serve as a wall panel 14 further includes a pair of end connectors 66, as illustrated.

Facing layer 56 has recesses formed therein to expose the side connector elements 74. Wall panels adapted to serve as corner wall panels, i.e., the panel at which a wall terminates in a corner formed with another wall disposed at a right angle to it, is provided with a full length extending recess such as shoulder recess 60 illustrated in FIG. 3. Thus, structural unit 36 of FIG. 3 is essentially modified to serve as a corner wall panel. If it were to be modified to serve as an intermediate wall panel, individual recesses 56 would preferably be utilized adjacent both side walls, in lieu of shoulder recess 60. Whether used as a corner wall panel or an intermediate wall panel, flange recess 62 and the flange connector disposed therein would not be normally required for a wall panel.

If structural unit 36 were to be adapted as a roof deck or floor deck panel, it would normally be provided with spaced apart side connectors as illustrated in FIG. 3 but not end connectors 66. Further, a plurality of flange connectors such as those disposed within flange connector recess 62 of FIG. 3 would be disposed at spaced apart intervals along at least one flange of those roof panels adapted to be employed at opposite outside edge segments of the roof deck. Flange connectors 62, as will be more fully described hereinbelow, would be utilized to connect the outside roof deck panels to the topmost portions of the wall panels on which the outside flange rests. Intermediate roof panels normally do not require flange connectors 62 along their length, unless they are to be connected to supporting interior walls.

Referring now jointly to FIGS. 3A, 3B and 3C, there is shown in FIG. 3A a further modified wall panel 14'' which has a doorway cutout 68 formed in web portion 46 thereof. FIG. 3B shows a differently modified wall panel 14''' having a window cutout 70 formed in web portion 46 thereof. Wall panel 14''' is also a reverse position wall panel, having a plurality of edge connector recesses 72 formed in, respectively, flange edges **52*a* and 54*a*. FIG. 3C shows the underside of a roof panel 18 with a plurality of flange connector recesses 62 disposed in spaced apart relationship along substantially the entire length of flange 54*a*. If required, flange 52*a*** could be similarly supplied with flange connectors. It will be appreciated that in some cases, to further standardize construction procedures, panels may be made with connectors, not all of which will be used in the assembly. In such a case, the recesses of unused connectors are simply filled after assembly, with grout or the like.

As indicated by the rendition of FIG. 3, it will be appreciated that standard construction unit 36 may vary in length, as well as its other dimensions, to suit specific needs. Generally, roof panels 18 and floor panels 30 are considerably longer than wall panels 14.

Figure 4:
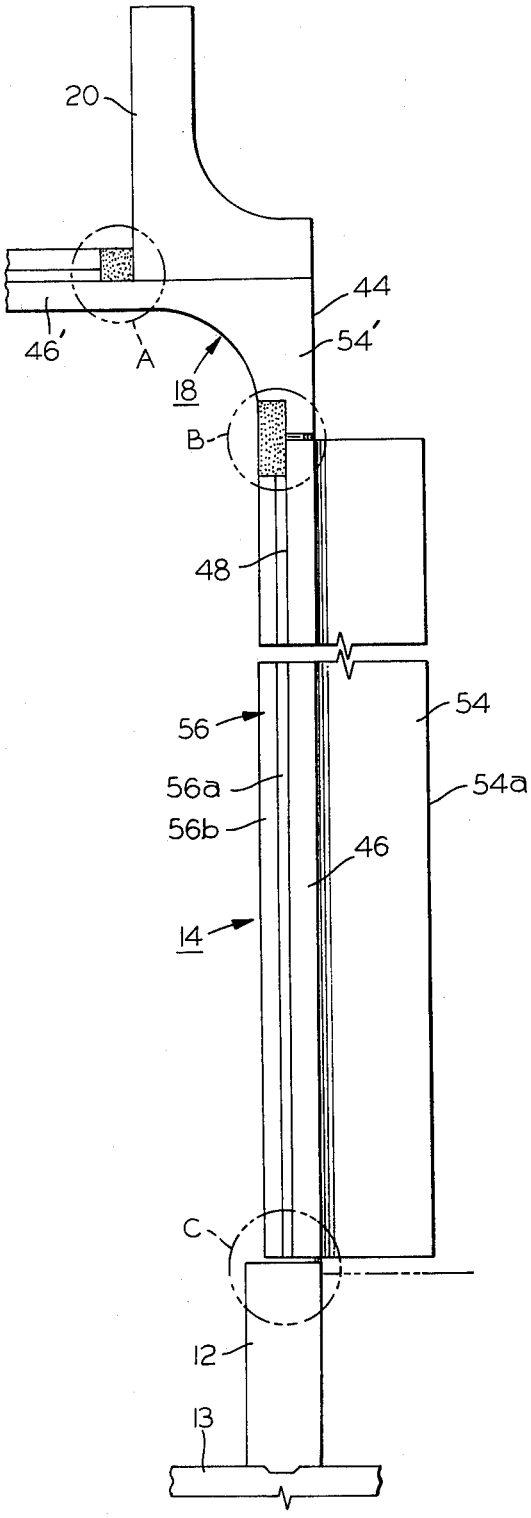
FIG. 4 is a partial section view in elevation corresponding to a section view along line 4—4 of FIG. 1.

Referring now to FIG. 4, there is shown in section elevation view a typical cross section such as might be obtained along line 4—4 of FIG. 1. For clarity of illustration, conventional section lining has been omitted from FIGS. 4, 4A, 4B and 4C. Using generally the same numbers as employed in FIG. 1, footing 12 has a base footing portion 13. Wall panel 14 has a lower end wall thereof supported on footing 12. A roof panel 18 is supported on the uppermost end wall portion of wall panel 14 with a flange 54' of roof panel 18 extending along and being supported upon respective upper end walls of panels 14 and its adjacent wall panels assembled into wall 14A (of FIG. 1). Parapet 20 is supported on and fastened to roof panel 18. For this purpose, roof panel 18 has side connectors disposed in its web portion well inwardly of its side wall 44, as described more fully with reference to FIG. 4A.

Wall panel 14 has a facing layer 56 affixed to and overlying significantly all of first surface 48 thereof. Facing layer 56 comprises a heat insulating layer **56*a* which abuts first surface 46 and a second, overlying layer 56*b* of cementitous material. Flange 54 of wall panel 14 has a flange edge 54*a*. Flange 52 of wall panel 14, not shown in FIG. 4, obviously has a corresponding flange edge 52*a*. Flange edges 52*a* and 54*a* correspond to those illustrated with respect to panel 14''' of FIG. 3B and roof panel 18 of FIG. 3C**.

Figure 5:
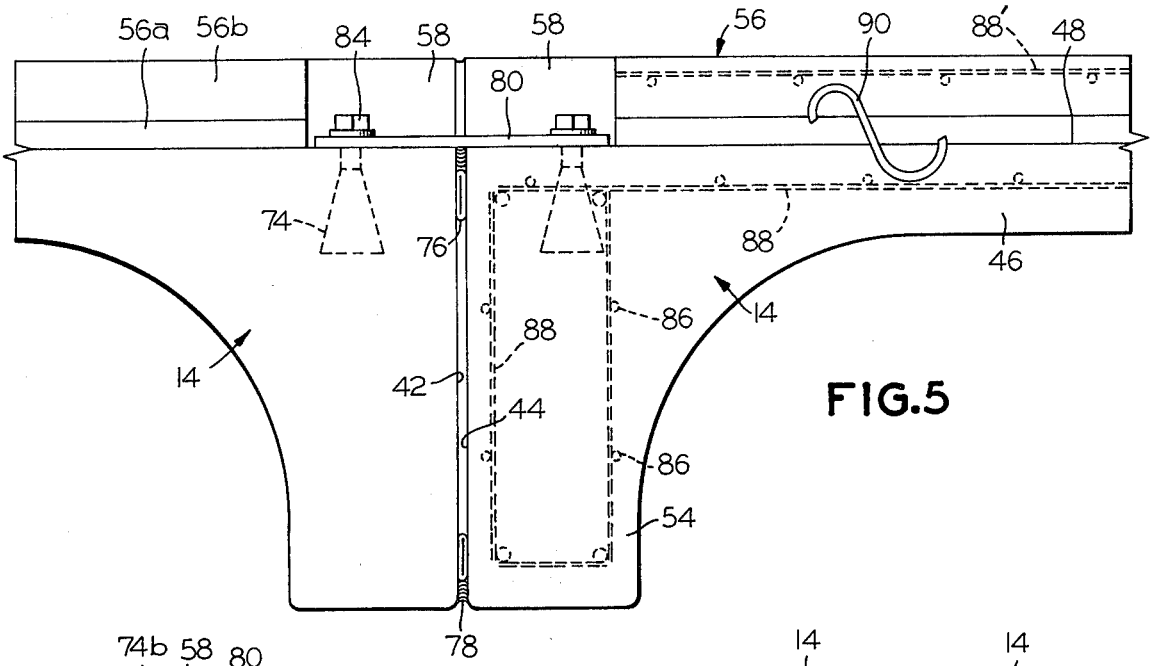
FIG. 5 is a fragmentary plan view showing two closely spaced vertically positioned standard construction units connected together as wall panels FIG. 5 alternately may be considered as showing two closely spaced horizontally positioned standard construction units connected together as roof deck panels.
Figure 5A:
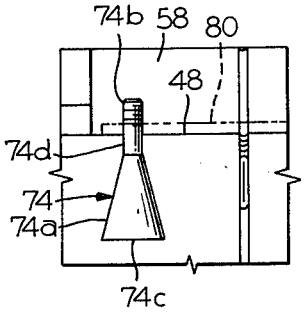
FIG. 5A is a fragmentary view; of a portion of FIG. 5 with parts broken away; for clarity of illustration.

Referring now to FIG. 5, there is illustrated in partial view a pair of wall panels 14 disposed in closely adjacent side wall to side wall relationship. For clarity of illustration, reinforcing and other internal members embedded within the panels are shown in dotted outline only in the right-hand panel 14 as seen in FIG. 5. Each of the panels has a recess 58 which would normally be filled with grout or other suitable packing material, but which is shown unfilled in FIG. 5 for clarity of illustration. Each panel 14 also has a side connector 74 having one end **74*a* embedded in a recess within the concrete body of panel 14 and an opposite end 74*b* projecting exteriorly of first surface 48 within recess 58 as seen in FIG. 5A. Side walls 42 and 44 of the two respective panels 14 of FIG. 5 are in closely adjacent side wall to side wall relationship to each other. Gasket material 76 and caulking 78 seal the space between adjacent panels 14. It will be appreciated that "closely adjacent side wall to side wall" relationship also describes a situation in which panels 14** are placed in directly abutting contact with one another. However, the provision of a small space between them is preferred as it allows for minor irregularities in dimension and provides, in effect, an expansion joint between adjacent panels.

Figure 7:
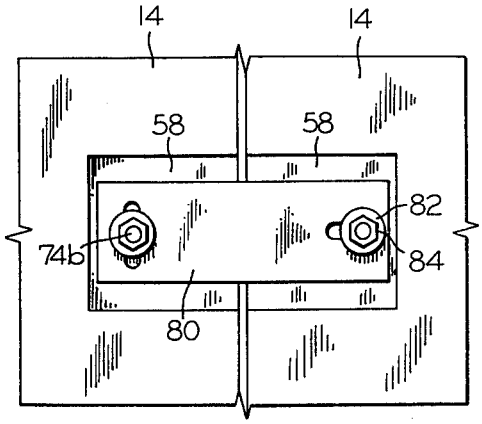
FIG. 7 is a partial plan view showing fastener means fastening a side connector of one standard construction unit to an adjacent side connector of an adjacent standard construction unit.

As best seen by considering FIGS. 5 and 7 jointly, adjacent panels 14 are connected by means of fasteners which may be tie plates such as tie plate 80, which is a rectangular steel plate having a pair of slots (unnumbered) formed therein. One slot has its longitudinal dimension disposed perpendicularly to the other, as shown in FIG. 7. This arrangement of the slots permits maneuvering of the plate to accommodate minor irregularities in the positioning of the respective opposite ends **74*b* of side connectors 74 when fitting tie plate 80 over adjacent ones of side connectors 74. A washer 82 and nut 84 are employed to secure tie plate 80 to respective adjacent side connectors 74, as shown. As will be appreciated from a consideration of FIG. 3, a plurality of side connectors 74 are employed on each of panels 14 and 18 at spaced apart intervals thereon. The number of side connectors and tie plates employed to interconnect to adjacent panels will depend on the size of the panels and design requirements. Recesses 58 are seen to be oversized relative to tie plate 80 to provide adequate room for ease of insertion of tie plate 80 and maneuvering to fit its slots over each of a pair of adjacent side connectors 74**.

Referring again to FIG. 5, panel 14 depicted in the right-hand portion thereof shows in dotted outline typical reinforcing members embedded therein. For example, a plurality of steel reinforcing rods 86 and steel reinforcing mesh 88 are embedded within the concrete of panels 14. Mesh 88 is formed into a box-like configuration within flange 54 and extends in a single layer across a web portion 46. Obviously, any suitable pattern and density and dimensions of reinforcing members 86, 88 or their equivalent may be employed as dictated by design requirements.

An S-shaped connector 90 has one end thereof embedded within panel 14 and a second end thereof projecting exteriorly of first surface 48 of panel 14. The second end of connector 90 is embedded within facing layer 56. A plurality of S-shaped connectors 90 are provided at spaced apart locations on first surface 48 and serve to help retain facing layer 56 affixed to panel 14. In the embodiment illustrated, it will be noted that the second end of connector 90 extends through both heat insulation layer **56*a* and an overlying cementitous grout layer 56b. Steel reinforcing mesh 88' is disposed within cementitous grout layer 56b** for structural reinforcement thereof.

As hereinabove indicated, FIG. 5 also serves to illustrate the arrangement of two adjacent roof panels in which case FIG. 5, instead of a plan view, would represent an end view in elevation with each of the panels 14 thereof comprising roof panels 18. The illustration remains essentially unchanged whether depicting adjacent wall panels or roof (or floor) panels. Of course, there might be changes in dimensions or size or disposition of embedded reinforcing members to account for the different load stresses imposed on roof deck panels 18 as opposed to wall panels 14.

Figure 6:
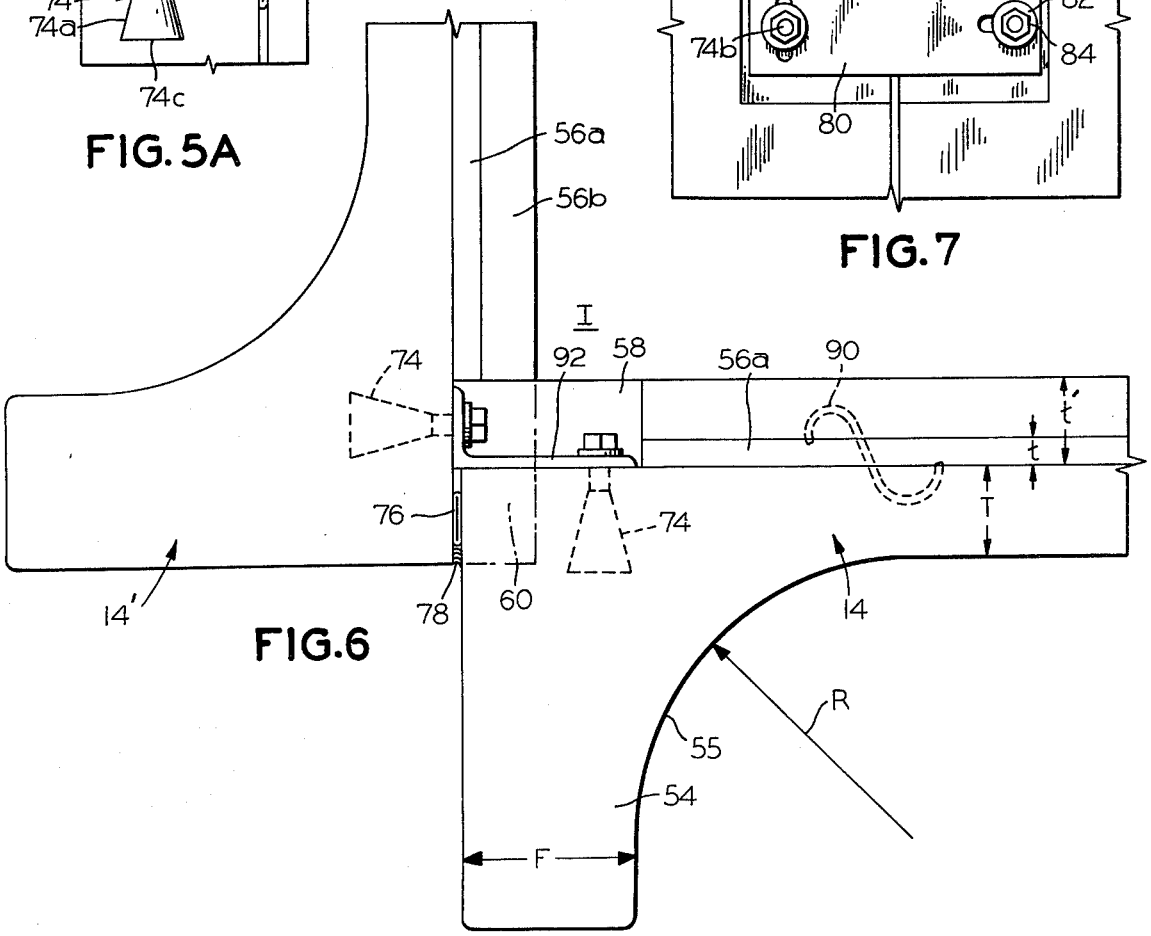
FIG. 6 is a fragmentary plan view showing two closely spaced, vertically positioned standard construction units connected together to form a corner at which two walls meet.

Referring now to FIG. 6, there is shown a plan view of two adjacent wall panels 14, 14'. Panel 14 is part of an adjacent wall such as wall 14B of FIG. 1. The two adjacent panels 14, 14' provide the corner at which the two walls meet. It will be noted, however, that FIG. 6 differs from FIG. 1 in that panel 14' is not a reversed position panel but, like panel 14, is positioned with its flanges disposed outwardly of the building interior, indicated by the letter I in FIG. 6. The dot-dash line in FIG. 6 represents shoulder recess 60 of panel 14' which is occupied by a portion of panel 14, as may be best understood by considering the right-hand portion of FIG. 3. Thus, one of the two adjacent corner panels is provided at one side wall thereof with a longitudinally extending shoulder recess 60 so that the two corner panels may be placed in closely adjacent, substantially abutting contact as indicated in FIG. 6. As above described, to allow for dimensional variations and to provide some clearance for assembly, the two panels are positioned closely adjacent to each other with a small space left therebetween which is filled by gasket 76 and caulking material 78. For clarity of illustration, reinforcing members have been omitted from FIG. 6 and an S connector 90 shown in dotted outline. An L-shaped tie plate member 92 is employed to interconnect side connectors 74 of panels 14 and 14' of FIG. 6 in a manner similar to that effected by tie plate 80 of FIGS. 5 and 7. Tie plates 92, as seen in FIG. 6, have a short leg and a long leg (unnumbered) in each of which there is disposed, respectively, a slot to receive the associated opposite end 74b (not numbered in FIG. 6) of side connectors 74.

Referring again to FIG. 5A, a typical side connector 74 is seen to have one end 74a of flared construction, having a base end 74c which is of greater diameter than its neck end 74d and more deeply embedded within its associated panel 14. Its opposite end 74b is threaded to receive a nut 84 (not shown in FIG. 5A) to secure tie plate 80 (shown in dotted outline in FIG. 5) to it. This construction of side connector 74 is typical of parapet connectors 74', flange connectors 96 and edge connectors 124. Obviously, other suitable forms of connectors may be employed.

Figure 4A:
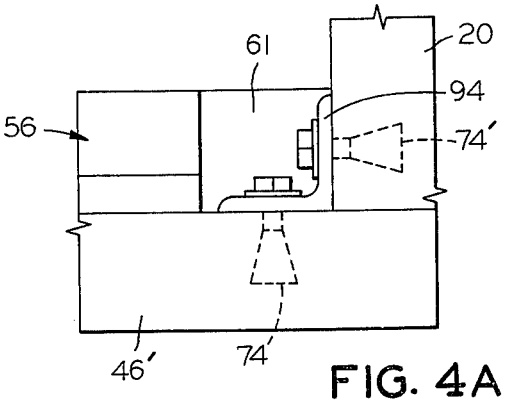
FIG. 4A is an enlarged view of that portion of FIG. 4 indicated at A.

Referring now to FIG. 4A, web portion 46 of roof panel 18 is seen to have a facing layer 56 including a heat insulative material disposed thereon. Roof panel 18 is of modified construction in that facing layer 56 terminates short of side wall 44 to provide in effect, a recess somewhat similar to that of shoulder recess 60 of FIG. 3, but of much greater width. Infact, a substantial portion of the total width of the first surface of web portion 46' of panel 18 of FIG. 4 is devoid of facing layer 56 in order to provide room to seat directly thereon parapet 20. Parapet 20, as best seen in FIG. 4A, has a parapet roof connector 74' which is similar in construction to side connector 74 of panel 18. Side connector 74 of panel 18 is spaced more inwardly of side wall 44 than the other side connectors to allow sufficient room for seating of parapet 20 thereon. Parapet 20 is connected to roof panel 18 by means of a second L-shaped tie plate connector 94 which, in the embodiment shown, has two substantially equal sized legs (unnumbered in FIG. 4A) each of which has formed therein a slot to receive the respective opposite end portion of connectors 74 and 74'. A washer and nut (unnumbered in FIG. 4A) secures tie plate 94 in place. Recess 61, between the edge of overlying layer 56 and parapet 20, is suitably filled with grout or other packing material after tie plate 94 is fastened in place. This procedure of filling the recesses with grout or other equivalent material after fastening the tie plates to the connectors is preferably followed with each of the recesses, both for aesthetic reasons and to protect the tie plates, nuts, washers and connectors from exposure to atmosphere and the elements.

It will be appreciated, as seen in FIG. 1, that if the entire roof periphery were supplied with parapets 20, the parapets would extend longitudinally along the first surface of web 18 adjacent the side wall thereof of outside edge roof panels of roof deck 16, and across the ends of all the roof panels 18 including the intermediate roof panels. All recesses in the roof panels, after fastening of the associated tie plates, are suitably filled with grout or the like. Although not shown in FIG. 1, it is apparent that parapet sections disposed transversely across the transverse ends of roof panels 18 would be fastened thereto by appropriately positioned side connectors. Overlying layer 56 would terminate short of the transverse ends of each of roof panels 18 to accommodate the transverse parapet or parapets.

Figure 4B:
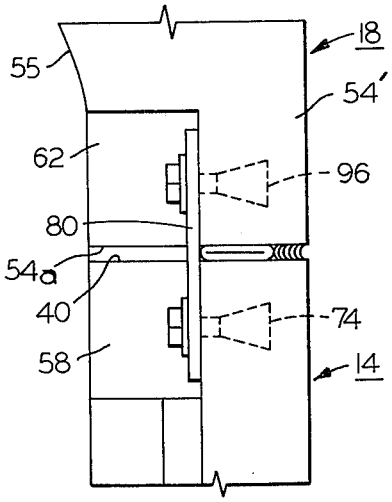
FIG. 4B is an enlarged view of that portion of FIG. 4 indicated at B.

Referring now to FIG. 4B, a flange connector recess 62 is formed within the inner side 55 of flange 54' and has disposed therein an opposite end of flange connector 96. Flange connector 96 is of substantially similar construction to side connector 74, such as the side connector 74 projecting into recess 58 of panel 14. The gasket and caulking material shown in FIG. 4B is unnumbered for clarity of illustration, and a tie plate 80 is fastened by nuts and washers (unnumbered in FIG. 4B) to respective opposite ends of flange connector 96 and side connector 74. A plurality of such connections are formed along the length of panel 18 to the upper ends of selected wall panels 14, adjacent uppermost or "second" transverse end walls 40. Although not shown in FIG. 4B for clarity of illustration, recesses 62 and 58 are filled with grout material as shown in FIG. 4 after the connections are made.

Figure 4C:
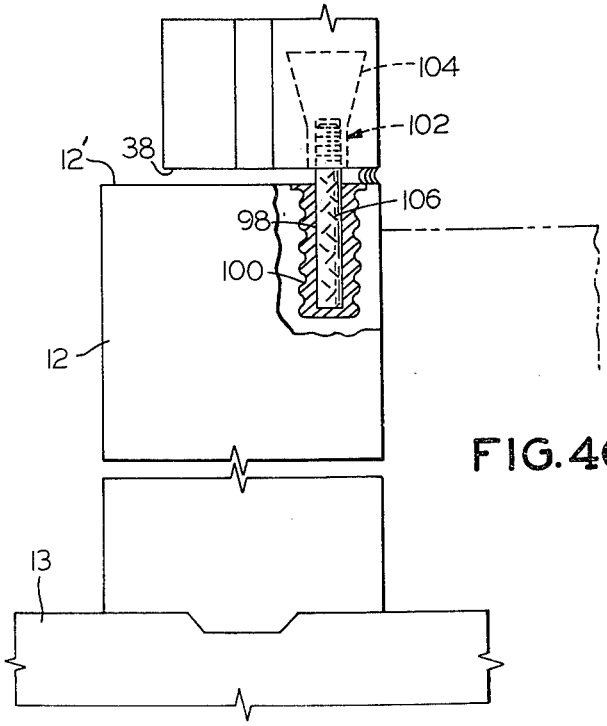
FIG. 4C is an enlarged view of that portion of FIG. 4 indicated at C.

Referring now to FIG. 4C, footing 12 is seen to have a support surface 12' upon which lowermost or "first" transverse end wall 38 is supported. Steel plate shims (not shown) and caulking and gasket material are interposed between lowermost end wall 38 and support surface 12'.

An opening 98 is formed in support surface 12', in the embodiment illustrated, by insertion of a corrugated tube 100 into the cement or other hardenable fluid mixture from which footing 12 is cast. An end connector generally indicated at 102 is comprised of one end 104 which has a flared outer surface similar to the one end of side connectors 74. However, the one end 104 of end connector 102 has a hollow, interiorly threaded neck portion within which is received a correspondingly threaded end of bar 106. Bar 106 projects exteriorly of first end wall 38 and comprises the opposite end of end connector 102. It will be apparent that bars 106 may be threaded into first end walls 38 after wall panels 14 have been hoisted into place above footing 12 and prior to their placement thereon. Prior to insertion of bars 106 within openings 98, openings 98 are filled with a fluid cementitous mixture or other suitable material which will harden after insertion of bars 106 therein to effectuate a permanent interconnection of wall panel 14 to footing 12. Bar 106 may have a surface provided with suitable corrugations, such as the usual striations of conventional reinforcing bars, to enhance its adherence within the hardened material placed within corrugated tube 100.

While, as above indicated, it will be apparent that the standard construction units in accordance with the invention may be made in any required dimensions, it has been found that, generally speaking, certain practical limits exist. For example, the maximum unsupported span length of a reasonably sized roof deck panel which provides adequate structural strength should not be more than about thirteen (13) meters. To provide adequate structural strength for a reinforced concrete panel, whether a roof panel 18 or a wall panel 14 or floor panel 30, a minimum thickness (exemplified by dimension T in FIG. 6) of about ten (10) centimeters is required. In order to provide adequate heat insulation a minimum thickness (exemplified by the dimension t in FIG. 6 of layer 56*a*) of about two and one-half (2.5) centimeters is required.

Generally, the entire overlying layer 56 should have a minimum thickness (exemplified by the dimension t' in FIG. 6) of about seven and one-half (7.5) centimeters. Accordingly, a typical combined thickness of web portion 46 and overlying layer 56 is about fifteen (15) centimeters.

Typical dimensions for a wall panel would be a flange width (exemplified by dimension F in FIG. 6) of about fifteen (15) centimeters with a radius of curvature (exemplified by dimension R in FIG. 6) of about twenty-five (25) centimeters for the concave inner side 55 of flange 54. The preferred width of a typical panel (exemplified by the dimension W in FIG. 3) would be up to about two and one-half (2.5) meters. Widths exceeding about 2.5 meters, although suitable for some purposes, tend to become unwieldy and to possibly adversely affect the ability of the standard construction unit to act as a channel member under stress.

As indicated above, for horizontally positioned roof deck or floor deck panels the unsupported length (exemplified by the dimension L in FIG. 3) should not exceed about 13 meters. For a typical wall panel the length would be about 2.5 to 3.0 meters to provide an average ceiling height for a room.

Typical dimensions for a tie plate 80 would be a steel plate about 0.95 centimeters thick, by 22.9 centimeters long by 8.9 centimeters wide (about 3/8 inch, by 9 inches by 3½ inches).

Generally, it is preferred that the weight of an individual standard construction unit not exceed about 20,000 pounds to facilitate lifting and positioning of the units by a relatively light duty crane. The standard construction unit, made of reinforced concrete and having a maximum width of 2.5 meters and a maximum length of 13 meters and other dimensions approximately as described above would weigh about 20,000 pounds.

While the various side connectors, end connectors and flange connectors may be positioned as required, generally, it is preferred that at least three side connectors be disposed adjacent each side wall of a wall panel 14 approximately equally spaced apart to insure adequate structural strength of the connection between adjacent wall panels 14.

Side connectors disposed adjacent the side walls of roof panels 18 should be spaced apart not more than about two meters on centers. Similar spacing applies to flange connectors of panels 18 serving to connect outside edge roof panels to the tops of the wall panels supporting the outside flange of an outside edge roof panel. Obviously, spacing and sizing of the fastener means may be varied to suit particular design requirements in a given case.

Figure 8:
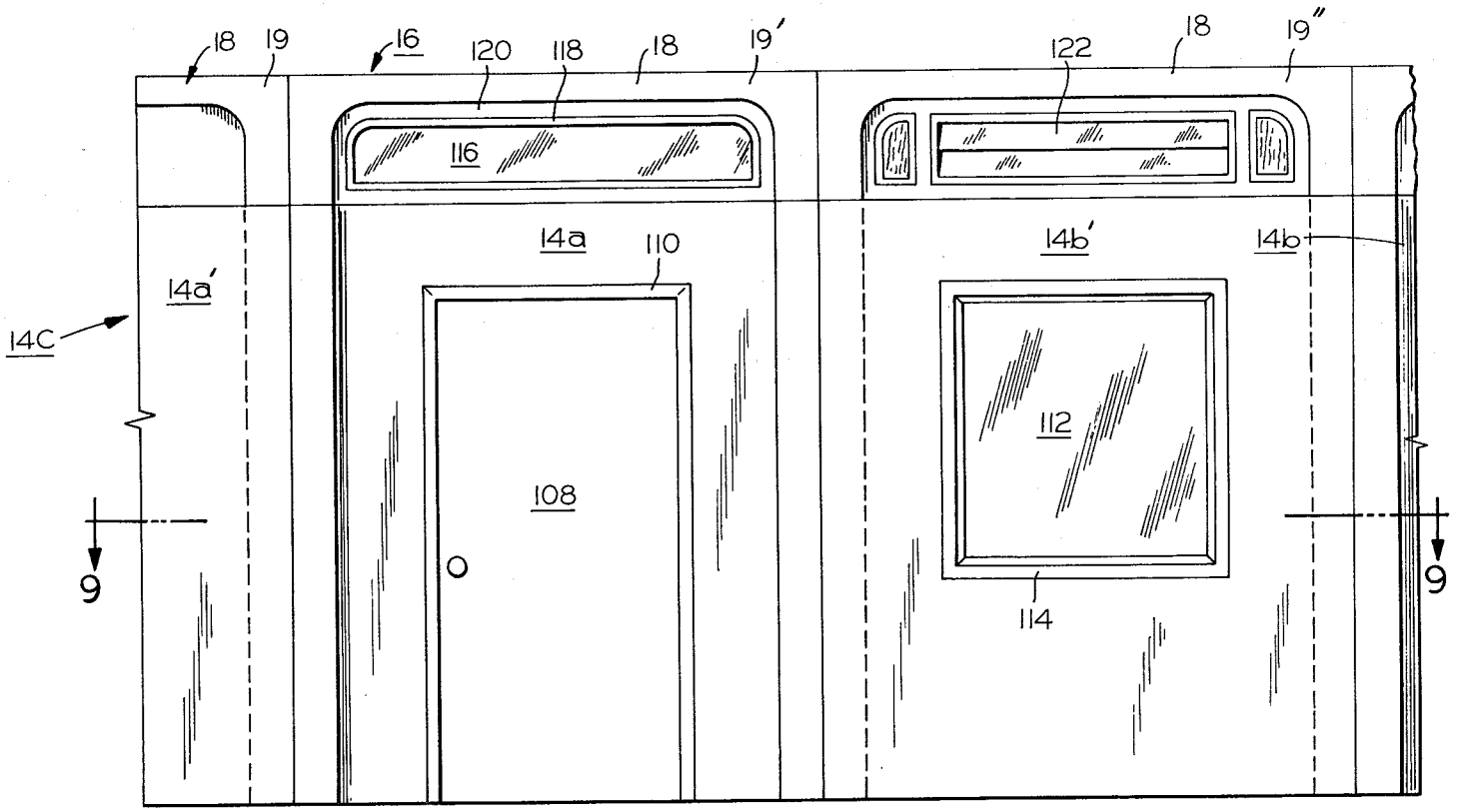
FIG. 8 is a fragmentary side elevational view showing a portion of a wall and roof deck of one embodiment of a building enclosure in accordance with the invention.
Figure 9:
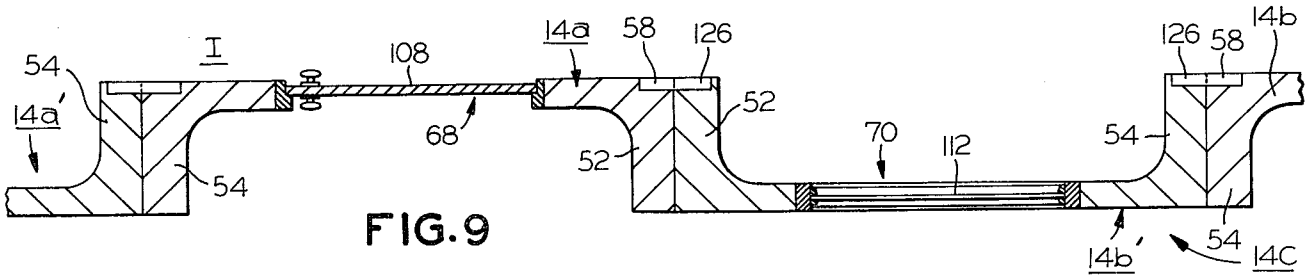
FIG. 9 is a sectional view taken along the line 9—9 of FIG. 8.

Referring now to FIGS. 8 and 9, a segment of a wall generally indicated at 14C is comprised of wall panels 14*a* and 14*b* and reverse positioned wall panels 14*a'* and 14*b'*. Panel 14*a* has a door way cutout 68 formed therein in which a door 108 is conventionally mounted within a doorframe 110. Panel 14*b* has a window cutout 70 within which a window 112 is conventionally mounted within a window frame 114.

Wall 14C is an end wall which is disposed relative to its associated roof deck 16 (comprised of roof panels 18) similarly to wall 14B of FIG. 1. That is, wall 14C extends transversely relative to roof panels 18. Thus, a short segment of both flanges of each roof panel 18 is supported upon a corresponding flange segment of second or uppermost end walls (unnumbered) in FIG. 8) of wall panels 14*a*, 14*b'*, etc.

For illustrative purposes, the inverted U-shaped opening resulting between uppermost second end walls of wall panels 14*a*, etc. and their associated roof panels 18 have been given different treatments in FIG. 8. Thus, the partially shown leftmost roof panel 18 in FIG. 8 has had its end opening filled with a cementitous material so that transverse end wall 19 of that roof panel 18 is closed. The filling may be made flush with end wall 19 so that it has a uniform flat surface, or the filling may be recessed slightly, as shown. Transverse end wall 19' of the next adjacent roof panel 18 has been fitted with a glass window 116 by means of a frame 118 to fill the invented U-shaped opening. Frame 118 may be arranged to pivot within an outer frame 120 so that window 116 may be opened or closed for ventilation as desired. The next adjacent roof panel 18 has a transverse end wall 19'' which has been similarly fitted with a louvered window 122 mounted within a suitable frame (unnumbered). Individual louvers may be opened or closed for ventilation. Generally, any suitable closure panel may be used, including screens to keep out insects, etc., or the opening may be left open.

Figure 9A:
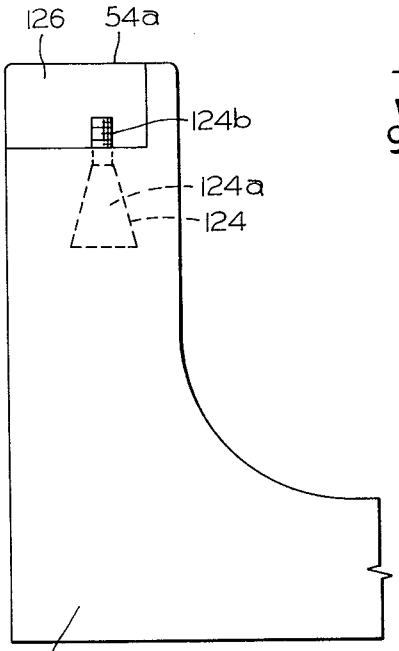
FIG. 9A is an enlarged partial plan view of one of the reverse connected standard construction units shown in FIG. 9.

It will be noted that wall panels 14*a* and 14*b* are positioned with their flanges 52, 54 facing outwardly of the interior enclosure (indicated by the letter I in FIG. 9) provided by the building of which wall 14C is a part. On the other hand, wall panels 14*a'* and 14*b'* are "reverse positioned" in that their flanges 52, 54 are facing inwardly of the building interior. This arrangement requires, in order to connect wall panel 14*a* to wall panel 14*b'* and wall panel 14*b''* to wall panel 14*b*, that edge connectors 124 (FIG. 9A) be provided in the reverse positioned panels to enable connection thereof as shown in FIG. 9 to side connectors 74 located in spaced-apart recesses 58 of wall panels 14*a* and 14*b*. Edge connectors 124 are similar to flange connectors 94 and side connectors 74 and have one end 124*a* embedded within its associated panel 14' (panel 14' of FIG. 9A is typical of either wall panel 14a' or 14b' in FIGS. 8 and 9) and an opposite end 124b which projects exteriorly of a recess 126 formed in flange edge 54a of panel 14'. Edge connectors 124 obviously are spaced identically relative to their associated wall panel as side connectors 74. In this manner, when adjacent panels such as wall panels 14b' and 14b are positioned in closely adjacent side wall to side wall relationship with one of them in the reverse position, a side connector 74 will be disposed adjacent an edge connector 124. In common with side connectors 74 and flange connectors 96, edge connectors 124 have flared or substantially cone-shaped base portions 124a which taper to a neck portion of lesser diameter. The base portions 124a are embedded within the panel and the opposite end 124b projects exteriorly of its associated panel. As with the other connectors, opposite end 124b essentially comprises a tie lug adapted to receive a fastener means such as tie plate 80 thereon.

The juxtaposed relationship of recesses 126 of "reverse" position panels and recesses 58 of the "normally" positioned panels is indicated in FIG. 9. Although not shown in FIG. 9A, recesses 126, like the other recesses within which the other opposite ends of the connectors project, are normally filled with a grout or cementitous material after the tie plate and fastening means have been secured to the tie lugs.

It will be seen that the invention provides a standard construction unit which may be modified by the formation of suitable recesses and placement of suitable side, edge, flange and/or end connectors as required to constitute the standard construction unit a suitable roof deck, wall or floor deck panel. As indicated, individual ones of the standard construction units may be further modified by provision of a door cutout or window cutout therein. The roof deck may be comprised of a single layer of roof panels 18 to comprise a simple roof deck 16 as indicated at the left-hand portion of FIG. 1. Roof panels 18 preferably are provided with the overlying layer 56 to provide a heat insulating layer thereover. Alternatively, a second layer of roof panels 18 may be employed, preferably laid transversely relative to the roof panels of first roof deck 16, to provide a second roof deck such as roof deck 16A illustrated at the right-hand portion of FIG. 1. This provides a further thermal barrier and is useful in, for example, tropic climates where the double layer roof construction is useful is providing sufficient heat insulation against a tropic sun. Similarly, where soil conditions permit, a simple slab-like floor may be employed. However, a floor deck similar to the roof deck 16 may be provided to accommodate poor soil conditions, or to provide a heat and dampness insulating hollow floor.

While FIG. 1 illustrates a single story building enclosure, it is apparent that the standard construction units of the invention may be employed to provide a multi-story enclosure. Generally, with the type of connectors illustrated in the preferred embodiments disclosed, structural considerations would limit the building to not more than two stories. If it were desired to use the standard construction units of the invention to produce a multi-story building two stories or more high, supplemental connectors would be required. These could take the form of continuous steel rods threaded through the panels comprising the different stories. The steel rods are tensioned by means of suitable tightening means such as nuts to provide a unitary steel rod or cable interconnecting several stories of superadjacent wall panel members. Normally, the steel rod is vertically positioned and passes through aligned conduits formed in the panels one above the other. Ends of the rod have washers or other retaining means to bear against the panels. This type of technique need not be described in detail since it is well known in the art and generally referred to as a post-tensioning of concrete members. The standard construction units of the invention are, as described above, monolithic by which term it is meant that they are cast as a single piece, unitary member in a continuous pour of cementitious or other suitable material.

Connectors similar to those employed as side connectors 74 as described above, may be employed to connect two modified construction joints together with fastener means such as tie plates 80 to form a column or girder structural member which has, in cross section, a roughly I-beam configuration as illustrated schematically in FIG. 2 of the drawings, such connectors would be disposed spaced apart from each other in sidewalls 42, 44 adjacent first surface 46 of web portion 98. Obviously, any other suitable connectors may be used, including connectors which are passed through web portions 46 of two suitably modified standard construction units placed in first surface 48 - to first surface 48 contact as illustrated at 34 in FIG. 2. The two units when fastened together by suitable fastener means may be disposed horizontally to serve as a girder or vertically to serve as a column. Normally, the units so employed are modified by not having the facing layer formed thereon.

Obviously, other modifications may be made to the standard construction units disclosed. For example, conduits could be cast integrally within the units to provide conduits through which electrical connections, etc., may be passed. For another example, the construction unit (e.g., panel 14) may be made with a recessed first surface (e.g., first surface 48) within which the facing layer (e.g., heat insulating material of layer 56) is disposed. The recess provides a lip of the cementitious panel material on the first surface around a part (or all) of the facing layer to protect it with a border of the cementitious material. Preferably, the recess is of rectangular configuration defining a very shallow U-shaped recess in the first surface and thus providing two opposite lips, one adjacent each of the opposite lateral side walls (e.g., side walls 42, 44) of the panel. This preferred construction protects the facing layer from abutting contact with adjacent panels when two panels abut to form a corner.

Generally, the flanges of the standard units, as shown in the drawings, for example, in FIGS. 1, 8 and 9, are adapted to project outwardly of the walls to provide a visible architectural feature thereof. As also shown in the drawings, the standard construction units are of U-shaped cross section for the entire length thereof.

While the invention has been described in detail with respect to specific preferred embodiments thereof, it will be apparent that upon a reading and understanding of the foregoing description, numerous alterations and modifications to the specific structure illustrated in the drawings may be made without departing from the spirit and scope of the invention. It is intended to include all such alterations and modifications within the scope of the appended claims.

What is claimed is:

1. A building enclosure having a multiplicity of side walls and a roof deck extending therebetween and comprising:

a. a multiplicity of standard construction units comprising a precast concrete monolithic panel of substantially rectangular configuration having a generally U-shaped transverse cross section defined by one face having a pair of flanges longitudinally extending along the sides thereof with the surface of said one face being substantially planar therebetween and by the other face thereof being substantially planar, each of said units having at least a plurality of longitudinally spaced-apart side connector elements along each side of said other face of said units;

b. a footing providing a support surface;

c. a multiplicity of said standard construction units being vertically disposed upon said footing to provide each of said side walls, said construction units having their side edges abutting and at least one of said side connector elements thereof horizontally aligned with a side connector element of the adjacent unit, and a multiplicity of said standard units having horizontally disposed upon the upper ends of said side walls and extending therebetween to provide said roof deck with said sides thereof in abutting relationship; and d. side fastener means bridging the adjacent sides of adjacent construction units in both said side walls and said roof deck, said fastener means being engaged with said connector elements of adjacent construction units.

2. The building enclosure in accordance with claim 1 wherein said side connector elements are embedded within said construction units and said side fastener means include plate members extending across the sides of said construction units and overlying said side connector elements and fasteners cooperating with said side connector elements to lock said plate members to said side connector elements.

3. The building enclosure in accordance with claim 2 wherein said plate members have slots therein and said fasteners are seated in said slots.

4. The building enclosure in accordance with claim 3 wherein said slots have their longitudinal axes disposed perpendicularly to each other.

5. The building enclosure in accordance with claim 1 wherein the flanges of at least some of said adjacent standard construction units have aligned, transversely extending apertures and fastener elements are seated in said apertures.

6. The building enclosure in accordance with claim 1 wherein said support surface of said footing and the lower ends of said standard construction units of said side walls have aligned apertures therein, and wherein there are included end connectors seated in said aligned apertures.

7. The building enclosure in accordance with claim 1 wherein said upper ends of said standard units of said side walls and the overlying portions of said standard units of said roof deck have aligned apertures therein, and wherein there are end connectors seated in said aligned apertures.

8. The building enclosure in accordance with claim 1 wherein the corners of said side walls include a pair of construction units extending perpendicularly to each other with the side wall of one unit abutting the other surface of the other construction unit and wherein said plate members are of L-shaped configuration.

9. The building enclosure in accordance with claim 7 wherein said standard units of said roof deck are disposed with the one face thereof lowermost so that said flanges thereof seat upon said upper ends of said standard units of said side walls and whereas said aligned apertures are in said flanges of said roof deck units.

* * * * *